US007058329B2

(12) United States Patent
Takahashi

(10) Patent No.: US 7,058,329 B2
(45) Date of Patent: Jun. 6, 2006

(54) FIXING APPARATUS

(75) Inventor: Katsumi Takahashi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 10/845,208

(22) Filed: May 14, 2004

(65) Prior Publication Data

US 2004/0258427 A1 Dec. 23, 2004

(30) Foreign Application Priority Data

May 15, 2003 (JP) ..... 2003-137143

(51) Int. Cl.
*G03G 15/20* (2006.01)

(52) U.S. Cl. ..... 399/69; 399/328

(58) Field of Classification Search ..... 399/38, 399/67, 69, 70, 320, 328, 330; 219/216, 219/243, 469

See application file for complete search history.

(56) References Cited

U.S. PATENT DOCUMENTS

| | | | | |
|---|---|---|---|---|
| 4,745,430 | A | 5/1988 | Tsuchiya | 355/3 FU |
| 4,796,035 | A | 1/1989 | Kawasaki et al. | 346/108 |
| 4,897,696 | A | 1/1990 | Matsumoto | 355/285 |
| 5,290,024 | A | 3/1994 | Takahashi | 271/122 |
| 5,474,287 | A | 12/1995 | Takahashi | 271/10.13 |
| 6,304,740 | B1 * | 10/2001 | Ciaschi et al. | 399/328 |
| 6,311,039 | B1 | 10/2001 | Funamizu et al. | 399/394 |
| 6,397,035 | B1 | 5/2002 | Kataoka et al. | 399/388 |
| 6,611,670 | B1 * | 8/2003 | Chen et al. | 399/328 |
| 6,853,831 | B1 * | 2/2005 | Hirst et al. | 399/328 |

FOREIGN PATENT DOCUMENTS

| | | |
|---|---|---|
| EP | 0 314 099 | 5/1989 |
| JP | 10-149044 | 6/1998 |
| JP | 11-24465 | 1/1999 |
| JP | 11-24489 | 1/1999 |

* cited by examiner

*Primary Examiner*—Hoan Tran
(74) *Attorney, Agent, or Firm*—Fitzpatrick, Cella, Harper & Scinto

(57) ABSTRACT

Image heating apparatus includes an image heating rotation member, for heating an image on a recording material, a driving device rotationally driving the image heating rotation member, an external heating member including an exothermic member heating the image heating rotation member in a way that contacts the image heating rotation member, a contacting-and-separating device for making the external heating member contact and separate from the image heating rotation member, a conduction control device for controlling conduction to the exothermic member so that a temperature of the external heating member becomes a target temperature, a contacting-and-separating state detecting device for detecting a contacting-and-separating state of the external heating member, and an abnormality detecting device for detecting an abnormality of the contacting-and-separating state of the external heating member rendered contacting and separating by the contacting-and-separating device, based on the detection by the contacting-and-separating state detecting device.

14 Claims, 11 Drawing Sheets

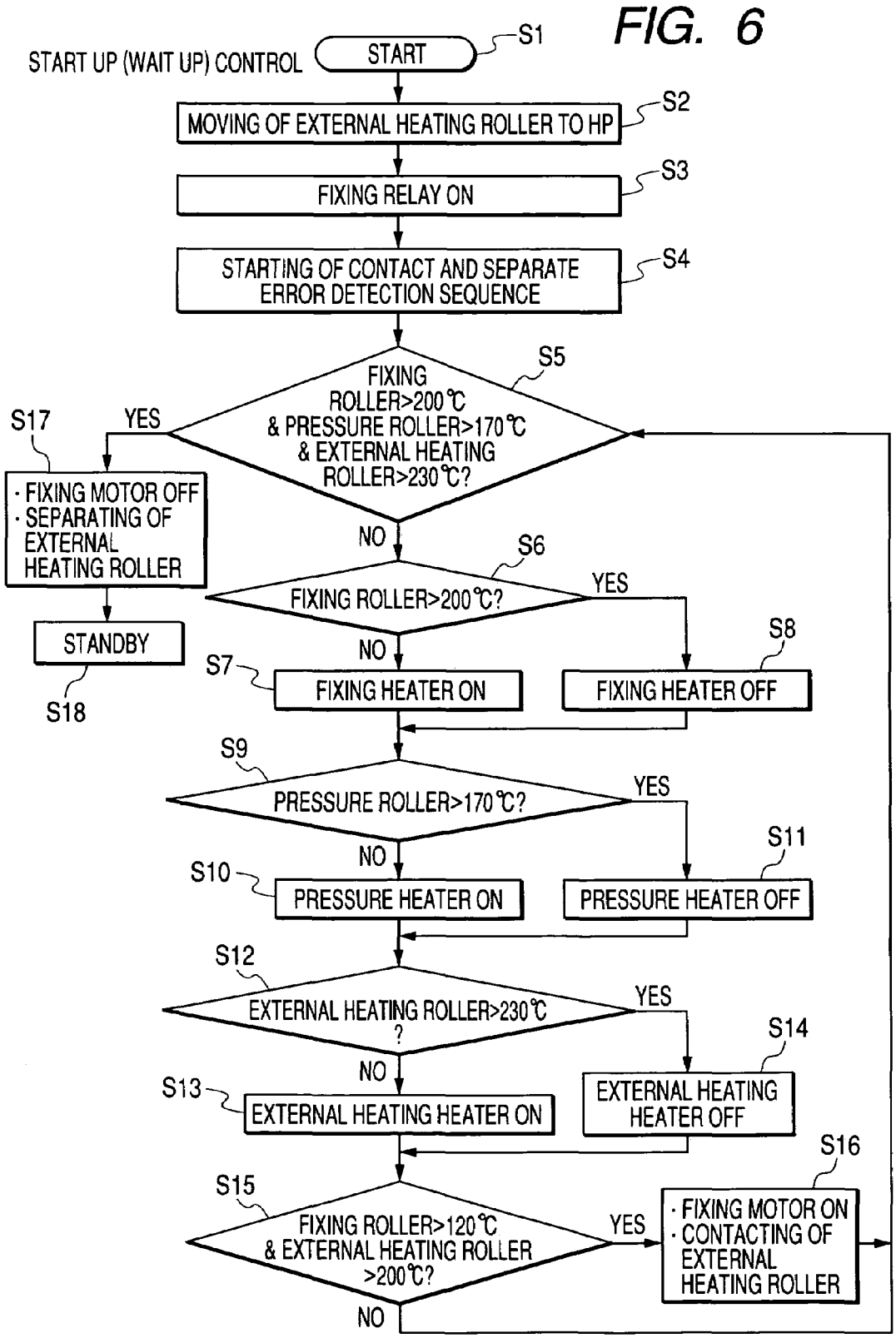
FIG. 6
START UP (WAIT UP) CONTROL
START
S1
MOVING OF EXTERNAL HEATING ROLLER TO HP
S2
FIXING RELAY ON
S3
STARTING OF CONTACT AND SEPARATE ERROR DETECTION SEQUENCE
S4
FIXING ROLLER>200℃ & PRESSURE ROLLER>170℃ & EXTERNAL HEATING ROLLER>230℃?
S5
YES
S17
· FIXING MOTOR OFF
· SEPARATING OF EXTERNAL HEATING ROLLER
STANDBY
S18
NO
FIXING ROLLER>200℃?
S6
YES
NO
S7
FIXING HEATER ON
S8
FIXING HEATER OFF
PRESSURE ROLLER>170℃?
S9
YES
NO
S10
PRESSURE HEATER ON
S11
PRESSURE HEATER OFF
EXTERNAL HEATING ROLLER>230℃?
S12
YES
NO
S13
EXTERNAL HEATING HEATER ON
S14
EXTERNAL HEATING HEATER OFF
FIXING ROLLER>120℃ & EXTERNAL HEATING ROLLER >200℃?
S15
YES
NO
S16
· FIXING MOTOR ON
· CONTACTING OF EXTERNAL HEATING ROLLER

FIXING APPARATUS

BACKGROUND OF THE INVENTION

1. Field of the Invention

The present invention relates to a fixing apparatus for melting and thus fixing a toner image on a transfer material in an image forming apparatus. The image forming apparatus involving the use of an electrophotographic system normally includes a fixing apparatus that melts and fixes together a transfer material and toners electrostatically borne on the transfer material, which consist of a resin, a magnetic substance, a coloring material, etc., by applying the heat and a pressure in the way of their being nipped and carried by a press-contact portion (nip portion) between a heating means (such as a roller, an endless belt member, and so on) and a pressure means (such as a roller, an endless belt member and so forth) that rotate in a mutually press-contact manner. The present invention further relates to a fixing apparatus including an external heating means for heating a heating means by abutting on (contacting) this heating means.

2. Description of the Related Art

In the image forming apparatus such as a copying machine, a laser beam printer or a facsimile, etc., what is known as a conventional fixing apparatus for thermally fixing an unfixed toner image transferred onto a recording material, is a fixing apparatus constructed of a fixing roller having a built-in exothermic member like a halogen lamp, etc. and a pressure roller similarly having a built-in exothermic member and brought into a press-contact with this fixing roller, wherein the recording material bearing an unfixed toner image is inserted in between the fixing roller and the pressure roller, the toners softened by a surface temperature of the fixing roller permeate fibers of the recording material, and the unfixed toner image is thus fixed onto the recording material.

The halogen lamps as the exothermic members of the fixing roller and of the pressure roller are controlled ON and OFF based on signals from temperature sensors attached to respective surfaces of the fixing roller and the pressure roller, whereby the surfaces are controlled at predetermined temperatures.

In the thus constructed heating roller type fixing apparatus, a nip portion for conveying the recording material while nipping the recording material, is formed owing to elastic deformation of an elastic layer on the fixing roller. Then, in this type of fixing apparatus, a transfer sheet bearing the unfixed toner image is passed through the nip portion, thereby melting and fixing the unfixed toner image onto the recording material by virtue of thermal energy and pressure.

In the case of the thus constructed fixing apparatus, the fixing roller and the pressure roller have their own elastic layers. Each of these elastic layers is composed of a comparatively-low-heat-conductivity elastic member such as a silicone rubber, etc., having a certain degree of thickness. Therefore, in the aforementioned fixing apparatus, if the surface temperatures of the fixing roller and the pressure roller become lower than the predetermined temperatures during the traveling of the recording material, the respective temperature sensors detect the decreases in temperatures, and the electricity conducts to the respective halogen lamps. Even if so, however, there might be a possibility where deterioration of the fixing occurs because of requiring a considerable period of time until the heat of the halogen lamps is transmitted to the surfaces via the elastic layers. Especially when increasing a process speed, the fixing deterioration occurs easily, and there arises such a problem as to restrict consecutive printing in order to prevent the occurrence of the fixing deterioration.

Such being the case, an already-proposed measure for solving this problem is a technology of bringing, as disclosed in Japanese Patent Application Laid-Open Nos. 10-149044 and 11-24489, an external heating roller kept at a high temperature into a contact with the surface of the fixing roller and thus relieving a decrease in temperature of the fixing roller surface.

In the case of this type of fixing apparatus, however, even when the surface temperatures of the external heating roller and the fixing roller are controlled within proper temperatures, if the external heating roller continues to be in contact therewith during a halt of the rotation of the fixing roller, the external heating roller continuously heats up one point on the fixing roller surface, resulting in a problem that this portion is damaged and deteriorated. Thus, the surface deterioration of the fixing roller leads to an occurrence of problems such as an image defect like gloss deterioration, etc., adhesion (offset) of the toners due to a decline of a releasing property of the surface of the fixing roller, exfoliating and deteriorating the recording material, and so forth.

A construction for coping with these problems is that, as disclosed in Japanese Patent Application Laid-Open No. 11-24465, the conduction to the heater of the external heating roller is kept OFF during the halt of the rotation of the fixing roller.

If the conduction to the heater of the external heating roller is set OFF, however, when an image forming signal is inputted, this requires restarting the conduction to the heater of the external heating roller and heating the external heating roller up to a predetermined temperature. Hence, a process starting from the input of the image forming signal and ending up with the image formation, is time-consuming.

It is therefore preferable to control the temperature of the external heating roller in a way that separates the external heating roller from the fixing roller after finishing the image formation while making the conduction to the heater of the external heating roller be in a standby state, etc., in order to prevent a damage to the fixing roller. This is attained on one hand, and on the other hand there is a necessity of reducing the deterioration of and the damage to the fixing roller surface which are caused by controlling the temperature for a long period of time in a state where the external heating roller abuts on the fixing member during the halt of the rotation of the fixing roller due to an abnormal stop of the rotation driving means, a defective operation of the contacting-and-separating means for making the external heating roller contact and separate, hang-up of software for controlling the rotation driving means and the contacting-and-separating means, and so forth.

Under such circumstances, it is an object of the present invention, which was devised to obviate the problems inherent in the prior arts given above, to reduce, in a way that heats an image heating member in a comparatively short time by controlling a temperature of an external heating member on standby, deterioration of and a damage to a fixing member due to abutment of an external heating member when there occurs an abnormality, such as an abnormal stop of a rotation driving means, a defective operation of contacting-and-separating means for making an external heating roller contact and separate, hang-up of software for controlling the rotation driving means and the contacting-and-separating means, and so on.

SUMMARY OF THE INVENTION

It is an object of the present invention to detect an abnormality of a contacting-and-separating state of an external heating means.

It is another object of the present invention to prevent the external heating means from separating from an image heating member when a rotation driving means abnormally stops, when a contacting-and-separating means for making an external heating roller contact and separate becomes defective in its operation and when software for controlling the rotation driving means and the contacting-and-separating means falls into a hang-up state.

It is still another object of the present invention to provide an image heating apparatus having a rotatable image heating rotation member, for heating an image on a recording material, a driving means for rotationally driving the image heating rotation member, an external heating member including an exothermic member and heating the image heating rotation member in a way that contacts (abuts on) the image heating rotation member, a contacting-and-separating means for making the external heating member contact and separate from the image heating rotation member, a conduction control means for controlling conduction to the exothermic member so that a temperature of the external heating member becomes a target temperature, a contacting-and-separating state detecting means for detecting a contacting-and-separating state of the external heating member with respect to the image heating rotation member, and an abnormality detecting means for detecting an abnormality of the contacting-and-separating state of the external heating member rendered contacting and separating by the contacting-and-separating means, on the basis of the detection by the contacting-and-separating state detecting means.

A further object of the present invention will become apparent from the following discussion.

BRIEF DESCRIPTION OF THE DRAWINGS

FIG. 6 is a flowchart showing control of the image forming apparatus according to the present invention;

DETAILED DESCRIPTION OF THE PREFERRED EMBODIMENT

An embodiment of the present invention will hereinafter be described with reference to the drawings.

Figure 1:
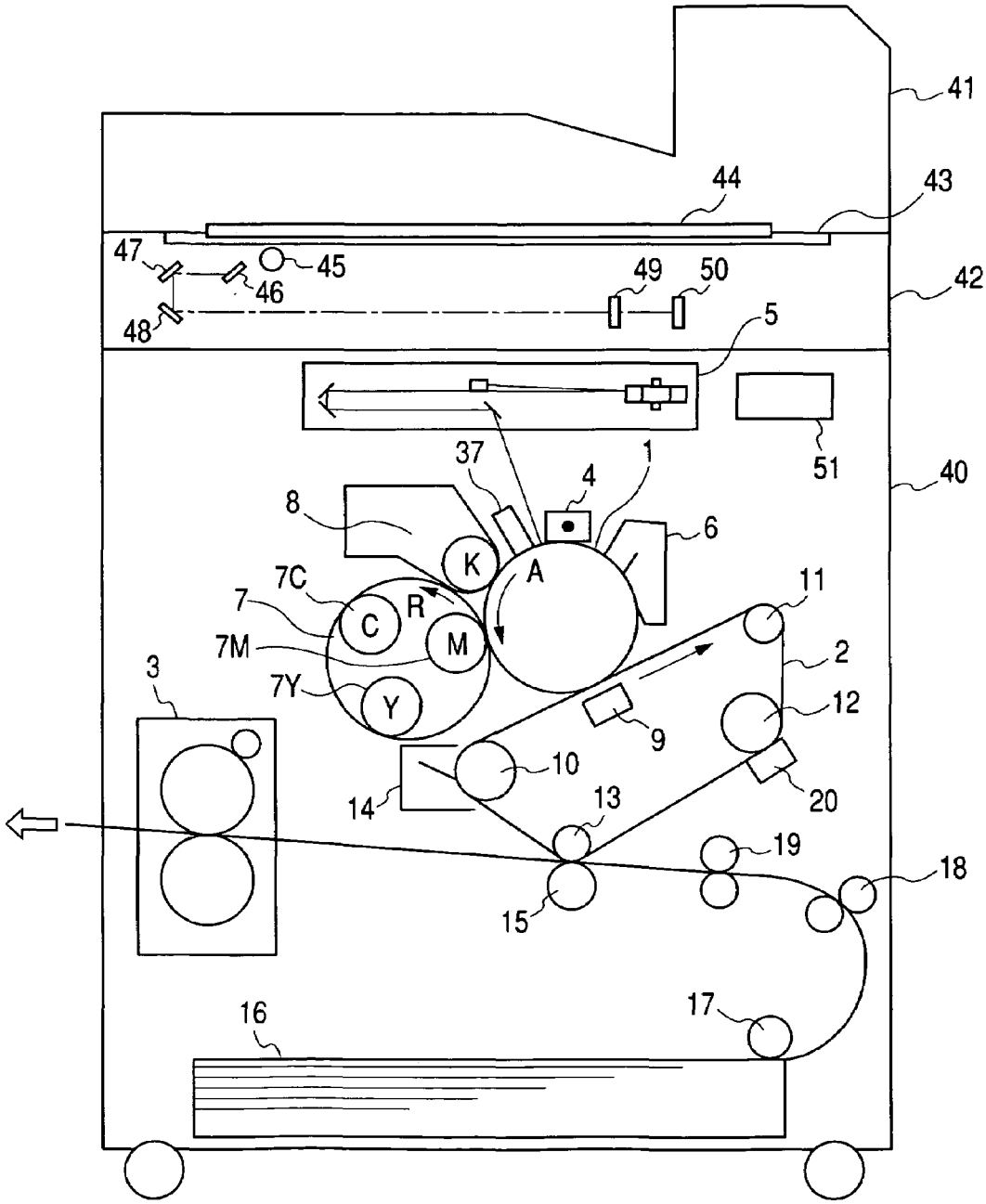
FIG. 1 is a view of a construction of an image forming apparatus according to the present invention.

FIG. 1 shows a color copying machine as an image forming apparatus to which a fixing apparatus according to the embodiment of the present invention is applied. Note that the fixing apparatus according to the embodiment of the present invention can be likewise applied also to image forming apparatuses such as printers, facsimile machines and so on.

(Whole Configuration of Image Forming Apparatus)

Referring to FIG. 1, the numeral 40 represents a main body of a color electrophotographic copying machine. An upper portion of the main body 40 of the color electrophotographic copying machine is provided with an automatic original conveying apparatus 41 for automatically conveying originals 44 in a way that separates the originals 44 sheet by sheet, and with an original reading apparatus 42 for reading an image of the original 44 conveyed by the automatic original conveying apparatus 41. The original reading apparatus 42 is constructed such that the original 44 placed on a platen glass 43 is illuminated with a light source 45, an image of light reflected from the original 44 is subjected to a scan-exposure over an image reading device 50 constructed of a CCD etc., through a reduction optical system consisting of optical mirrors 46, 47, 48 and an image forming lens 49, and the image reading device 50 reads the color material reflected light image of the original 44 with a predetermined dot density.

The color material reflected light image of the original 44 read by the original reading apparatus 42 is sent as three primary color data of R (Red), G (Green) and B (Blue) to an image forming apparatus 51. The image forming apparatus 51 executes image processing such as shading correction, Gamma correction, color space processing, etc., with respect to the R-, G- and B-data of the original 44.

Then, the image data subjected to the predetermined image processing in the image forming apparatus 51, are sent as image data of Y (Yellow), M (Magenta), C (Cyan) and K (Black) to an image control portion 5. The image control portion 5 performs an image exposure to laser beams corresponding to the image data.

The image exposure by the exposing apparatus (image control portion) 5 is effected over a photosensitive drum 1 (which will hereinafter simply be referred to as a (photosensitive member)) defined as an image bearing member. The drum 1 is so provided as to be rotatable in an arrow-head-A direction by a motor as a driving means. Disposed along a periphery of the photosensitive member 1 are a primary charger 4, an electric potential sensor 37, the image control portion 5, a color developing unit 7, a chromatic developing unit 8, a transfer charger 9 and a cleaner apparatus 6.

The image formation involves, at first, applying a voltage to the charging apparatus (primary charger) 4 and thus minus-charging a surface of the photosensitive member 1 uniformly with a predetermined charging portion potential. This charging level is detected by the potential sensor 37, and an output intensity of the charging apparatus 4 is feedback-controlled based on a result of this detection. Subsequently, the exposing apparatus 5 constructed of a laser scanner conducts, based on the image data, an exposure so that an image portion on the charged photosensitive member 1 comes to the predetermined exposing portion potential, thereby forming a latent image. The image control portion 5 performs ON/OFF operations based on the image data, thus forming latent images corresponding to the images.

The color developing unit 7 is constructed of three pieces of developing apparatuses 7Y, 7M and 7C for full-color developments. The color developing apparatuses 7Y, 7M, 7C and the chromatic developing apparatus 8 develop the latent images on the photosensitive member 1 by use of Y-, M-, C and K-toners, respectively. When developing with the toners in respective colors, the color developing unit 7 is rotated in an arrowhead-R direction by the unillustrated motor, and the developing apparatus corresponding to the color concerned is aligned to abut on the photosensitive member 1.

Toner images assuming the respective colors, which have been developed on the photosensitive member 1, are sequentially transferred onto a belt 2 defined as an intermediate transfer member by a transferring apparatus 9, whereby 4-color toner images are superposed on each other. A cleaner 14 having cleaning blades as cleaning means is provided in a position opposite to a transfer belt drive roller 10 with the belt 2 interposed therebetween, whereby residual toners on the belt 2 are scraped off by the blades.

The toner images transferred onto the belt 2 are further transferred onto a recording material by a secondary transferring apparatus 15. When in full-color printing, the 4-color toners are superposed on each other over the belt, and thereafter the 4-color toner images are transferred onto the recording material. The recording material is picked up and drawn to a conveying path out of a recording material cassette 16 by a pick-up roller 17, and is fed by a couple of conveying rollers 18, 19 to a nip portion, i.e., an abutting portion between the secondary transferring apparatus 15 and the belt 2.

Further, a preparatory cleaning apparatus reduces the charges of the residual toners on the photosensitive member 1 down to an easy-to-clean state, wherein the residual toners are removed and thus collected by the cleaner apparatus 6 including the cleaning blades as the cleaning means. Finally, the photosensitive member 1, of which the charges uniformly are eliminated by a charge eliminating apparatus down to the vicinity of 0 volt, gets ready for a next image forming cycle.

The recording material onto which the toner images have been transferred is thereafter fed to a fixing apparatus 3 serving as an image heating apparatus. The recording material, on which the toner images have been thermally fixed by the fixing apparatus 3, is discharged outside the apparatus.

Now, an image forming timing by the color copying machine is controlled, wherein a predetermined position on the belt 2 is used as a fiducial position. The belt 2 is looped around rollers 10, 11, 12 and 13. Among these rollers, the transfer belt drive roller 10 is linked to an unillustrated drive source and functions as a drive roller for driving the belt 2, the transfer belt tension rollers 11, 12 function as tension rollers for adjusting a tension of the belt 2, and the backup roller 13 functions as a backup roller for the transfer roller 15 as a secondary transferring apparatus.

A reflection type sensor 20 for detecting the fiducial position is disposed in the vicinity of the tension roller 12. The reflection type sensor 20 detects markings such as reflection tapes, etc. provided on side end portions of an outer peripheral surface of the belt 20, and outputs I-top signals.

A ratio of a length of the outer periphery of the photosensitive member 1 to a peripheral length of the belt 2, is set to an integer ratio given by 1:n (n is an integer). With this setting done, the photosensitive member 1 makes an integer number of rotations during one round made by the belt 2 and thus returns to absolutely the same state as before the belt 2 makes one round, whereby a color deviation due to unsynchronized (ununiform) rotations of the photosensitive member 1 can be avoided when the four colors are superposed on the intermediate transfer belt 2 (when the belt 2 makes four rounds).

In the image forming apparatus in the intermediate transfer system described above, after the predetermined time has elapsed since the I-top signal was detected, the image control portion 5 constructed of the laser scanner starts the exposure. Further, as explained above, the photosensitive member 1 makes the integer number of rotations during one round made by the belt 2, and returns absolutely to the same state as before the belt 2 makes one round. Hence, the toner image is formed invariably in the same position on the belt 2. A range where absolutely none of the toner images are borne exists on the belt 2, though a size of the toner image changes depending on a sheet size.

(Control System of Image Forming Apparatus)

Figure 2:
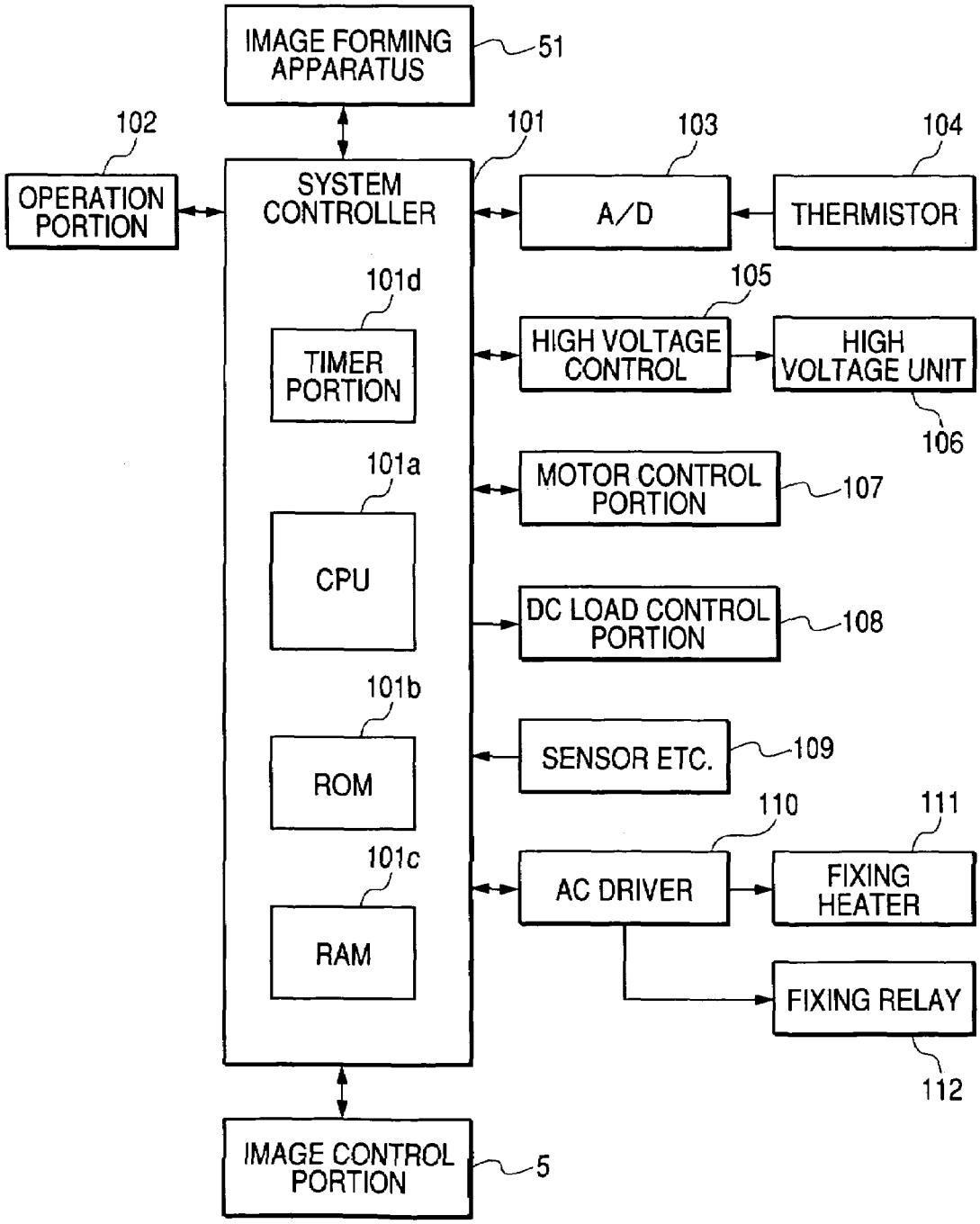
FIG. 2 is a block diagram of a control system of the image forming apparatus according to the present invention.

Next, FIG. 2 shows a block diagram of a control system of the image forming apparatus.

The whole image forming apparatus is controlled in unification by a system controller 101 as a control means. The system controller 101 functions to drive respective loads mainly within the present apparatus, gather and analyze pieces of information of sensors, etc., and exchange data with an operation portion 102, i.e., a user interface in addition to the aforementioned image forming apparatus 51 and image control portion 5. An internal configuration of the system controller 101 is that a CPU 101*a* is mounted for taking the roles described above and executes a variety of sequences related to a predetermined image forming sequence as a program stored on a ROM 101*b* similarly mounted in the system controller 101 instructs. Further, on this occasion, a RAM 101*c* is also mounted for storing rewritable data that need saving temporarily or permanently. The RAM 101*c* is to be stored with, for example, a high voltage set value to a high voltage control portion 105 that will be explained later on, various categories of data that will also be explained later on, image forming instruction information given from the operation portion 102, and so forth.

The data exchange with the image forming apparatus 51, the image control portion 5 and the operation portion 102 will be described as a first role of the system controller 101. With respect to the image forming apparatus 51, the system controller 101 effects image processing such as an A/D conversion, S/H, shading correction, masking correction, changing a magnification, a LOG conversion, etc., upon the image signals from the CCDs. In addition to sending specification set value data of the respective portions that are needed for these categories of image processing, the system controller 101 receives signals such as an original image density signal from each of the portions, and performs setting for forming an optimum image by controlling the high voltage control portion 105 and the image control portion 5 as will be described later on. With respect to the image control portion 5, the system controller 101 optimally controls a laser on the basis of a specification of the image size for forming the image and digital video data subjected to the image processing. Namely, in the present apparatus, the system controller 101 conducts the setting necessary for having beams emitted from the laser subjected to PWM processing. With respect to the operation portion 102, in addition to obtaining pieces of information such as a copying magnification, a density set value set by a user, the system controller 101 sends pieces of information showing a state of the image forming apparatus such as the number of images to be formed and showing whether the image formation is underway or not and data for indicating to the user the occurrence of a jam and where the jam occurs.

Next, the operations of driving the respective loads within the apparatus and gathering and analyzing the information of the sensors, etc., will be described as a second role of the system controller 101. In the present apparatus, a motor, DC loads such as a clutch/solenoid, etc., and sensors such as a photo-interrupter, a micro switch etc., are disposed in respective positions inside the apparatus. Namely, the recording material is conveyed and the respective units are driven by properly driving the motor and the individual DC loads, and the variety of sensors monitor the operations thereof. Then, the system controller 101 instructs the motor control portion 107 to control the respective motors on the basis of signals transmitted from the variety of sensors 109, and simultaneously instructs a DC load control portion 108 to operate the clutch/solenoid, thereby smoothly proceeding with the image forming operation. Further, the system controller 101 transmits a variety of high voltage control signals to the high voltage control portion 105, thereby applying adequate high voltages to the primary charger 4, the color developing unit 7, the chromatic developing unit 8 and the transfer charger 9 which are classified as the variety of chargers structuring the high voltage unit 106. Moreover, a fixing roller 21 in the fixing apparatus 3, a pressure roller 23 and an external heating roller 29 as an external heating member have built-in heaters 111 as exothermic members for heating the individual rollers. Each heater is controlled ON and OFF by an AC driver 110 (herein, heaters 22, 24, 30 as the exothermic members for the respective rollers are represented by the heater 111). Further, on this occasion, each of the fixing roller 21, the pressure roller 23 and the external heating roller 29 is provided with a thermistor 104 as a temperature detecting member for detecting a temperature thereof (herein, thermistors 34, 36, 32 for the respective rollers, which will hereinafter be described, are represented by the thermistor 104). A resistance value of the thermistor 104 changes corresponding to changes in temperatures of the rollers 21, 23, 29, and these changes in the resistance value are, after being converted into voltage values by an A/D converter 103, inputted as digital values to the system controller 101. The AC driver 110 is controlled based on temperature data thereof.

Further, the AC driver 110 also drives a fixing relay 112 for conducting/cutting off the electric power supplied to the heaters for heating the fixing roller 21, the pressure roller 23 and the external heating roller 29, respectively. The fixing relay 112 is controlled based on ON/OFF control signals given from the system controller 101. When an abnormality, etc., occurs in the apparatus, the fixing relay 112 cuts off the power sources of all the heaters, thereby protecting the image forming apparatus. Herein, the fixing relay 112 constitutes a common switch means as a switch device.

(Configuration of Fixing Apparatus)

Figure 3:
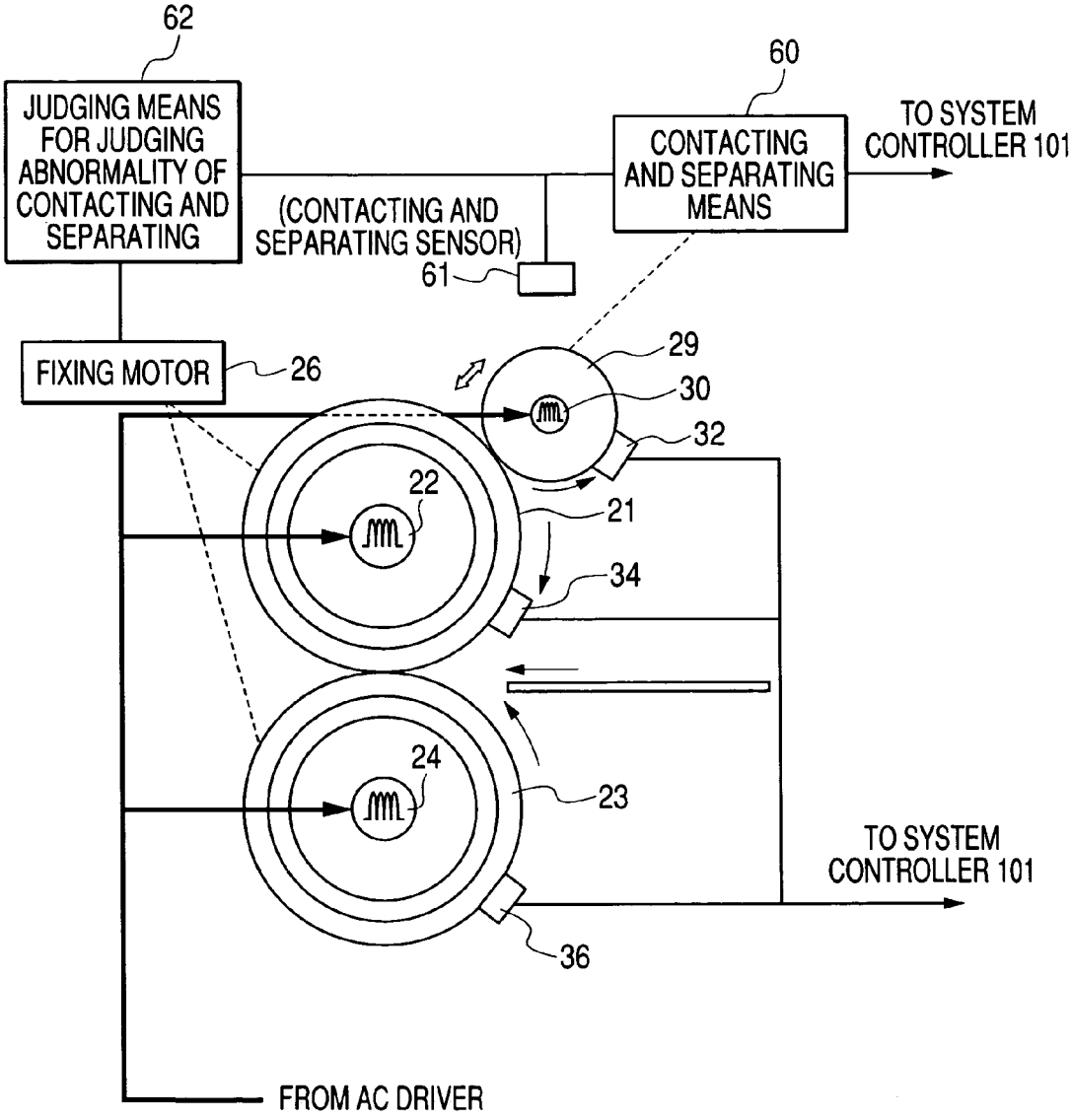
FIG. 3 is a view showing an outline of a fixing apparatus according to the present invention.

FIG. 3 is a view showing a configuration of the fixing apparatus according to the embodiment of the present invention.

The fixing apparatus 3 includes the fixing roller 21 serving as an image heating rotary member having inside a halogen heater 22 defined as a first exothermic member, and the pressure roller 23 serving as the pressure member having similarly inside a halogen heater 24 defined as a second exothermic member, thereby configuring a fixing means in which the fixing roller 21 and the pressure roller 23 are rotatably disposed while being mutually kept in a press-contact state by a pressure mechanism.

The fixing roller 21 and the pressure roller 23 receive a transfer of the driving force from the fixing motor 26 as a rotation driving means, whereby the rollers 21 and 23 rotate. The system controller 101 controls the fixing motor 26 so as to be driven and stopped according to an operation mode of the color copying machine, conditions such as a surface temperature of the fixing roller, and so forth. Further, the fixing motor 26 is provided with a rotation detecting means from which to output a rotation detecting signal indicating whether the motor is in a predetermined rotation state or not. This rotation detecting signal is inputted to a contacting-and-separating abnormality judging means 62 as an abnormality detecting means for detecting an abnormality of a contacting-and-separating state of an external heating member that will be explained later on, and to the system controller 101 as the control means.

The thermistors 34, 36 as temperature detecting members abut on the fixing roller 21 and the pressure roller 23, and detect surface temperatures of the fixing roller 21 and the pressure roller 23. As described above, the system controller 101 controls, based on these pieces of detection information, the halogen heater 22 and the halogen heater 24 through the AC driver 110, thereby controlling the temperatures of the fixing roller 21 and the pressure roller 23 so as to be kept at set temperatures (wherein, the fixing roller 21 is set at 200° C., and the pressure roller 23 is set at 170° C.).

The fixing roller 21 is 3 mm in thickness and 40 mm in diameter and is constructed such that a HTV (High Temperature Vulcanizing type) silicone rubber layer as an elastic member is provided along an outer periphery of core metal composed of aluminum, and a RTV (Room Temperature Vulcanizing type) silicone rubber layer as a heat resistance elastic member is provided along an outer periphery of the HTV silicone rubber layer.

On the other hand, the pressure roller 23 is 40 mm in diameter and is constructed such that the HTV silicone rubber layer having thickness of 1 mm is provided as an elastic member along the outer periphery of the core metal of aluminum, and a fluororesin layer is provided as a releasing layer along the outer periphery of the HTV silicone rubber layer. A releasing property from the toners is further enhanced by combining the thus-constructed fixing roller 21 and pressure roller 23.

Moreover, the external heating roller 29 as the external heating member is so constructed as to be able to contact and separate from the outer peripheral surface of the fixing roller 21.

The external heating roller 29 is contrived to contact and separate from the outer peripheral surface of the fixing roller 21 through a contacting-and-separating means 60 on the basis of signals from a contacting-and-separating sensor 61 as a contact-and-separating detection means for detecting a contacting-and-separating state with respect the fixing roller 21 under the control of the system controller 101. The contacting-and-separating sensor 61 is a sensor for detecting whether the external heating roller 29 is in a contacting position or in a separating position on or from the fixing roller 21, and state signals thereof are inputted also to a contacting-and-separating abnormality judging means in an electric circuit that will hereinafter be described.

The external heating roller 29 is, when contacting the fixing roller 21, subjected to the press-contacting by a spring as an elastic member and is rotationally driven by the fixing roller 21. Further, the external heating roller 29 is supported on a support rod such as an adiabatic bush or the like. Then, the support rod is moved by the contacting-and-separating means 60, thereby contacting and separating from the fixing roller 21. This contacting-and-separating operation is attained by utilizing a motor, a spring clutch, a solenoid, etc. as the known technologies.

An interior of the external heating roller 29 has a built-in halogen heater 30, for external heating, serving as a third exothermic member. The external heating roller 29 is constructed such that the metal surface of the outer periphery thereof is coated with a metal such as aluminum, iron, stainless steel, etc. exhibiting a high heat conductivity, or a rubber, a resin, ext. exhibiting a high releasing property.

Moreover, the thermistor 32 as the temperature detecting member abuts on the external heating roller 29, and detects a surface temperature of the external heating roller 29. As described above, the system controller 101 controls, based on this piece of detection information, the external heating heater 30 through the AC driver 110 and controls the apparatus so that the external heating roller 29 is kept at a set temperature (wherein, the external heating roller 29 is set at 230° C).

A not-yet-fixed image formed by a developer such as the toners or the like transferred onto the recording material is carried through the nip portion between the fixing roller 21 and the pressure roller 23, and is heated, pressurized and fixed onto the recording material by the thus temperature-adjusted fixing apparatus 3.

Figure 4:
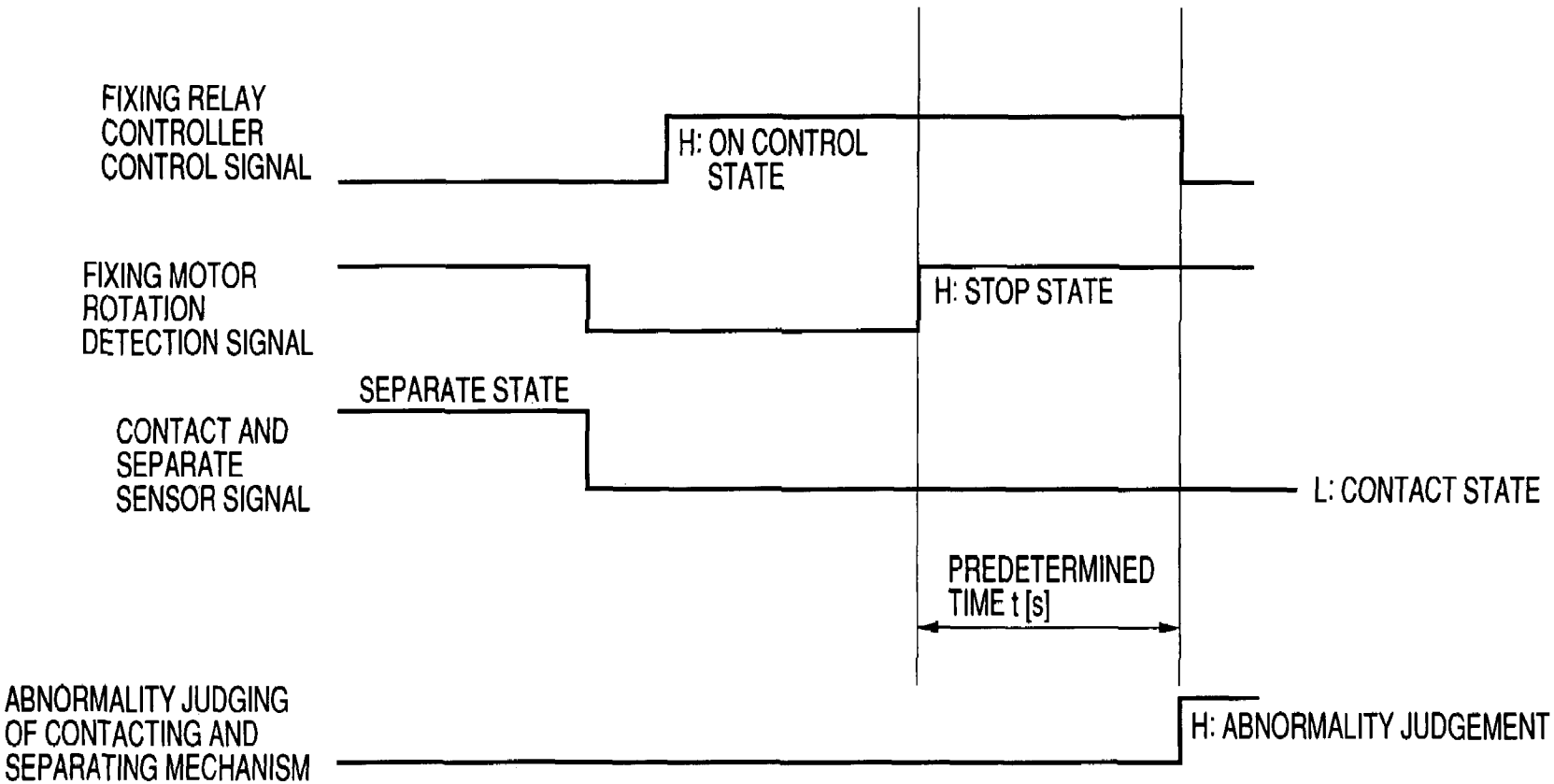
FIG. 4 is a diagram showing a processing content of an abnormality judging means of a contacting-and-separating mechanism according to the present invention.

Next, the embodiment of the present invention will be explained in depth with reference to FIGS. 4 and 5. FIG. 4 is a sequence diagram in which the contacting-and-separating mechanism detects the abnormality judged from logic of three categories of signals such as a control signal of the fixing relay 112, a rotation detection signal of the fixing motor 26 and a contact state signal of the contacting-and-separating sensor 61, which are inputted to the contacting-and-separating abnormality judging means 62. It should be noted that the fixing relay 112 receives the control signal outputted from the system controller 101 in the present embodiment, however, it may be constructed to receive the signal from other units on the condition that a drive state of the fixing relay can be detected from this signal. Herein, the system controller 101 configures a common switch control means.

Figure 5:
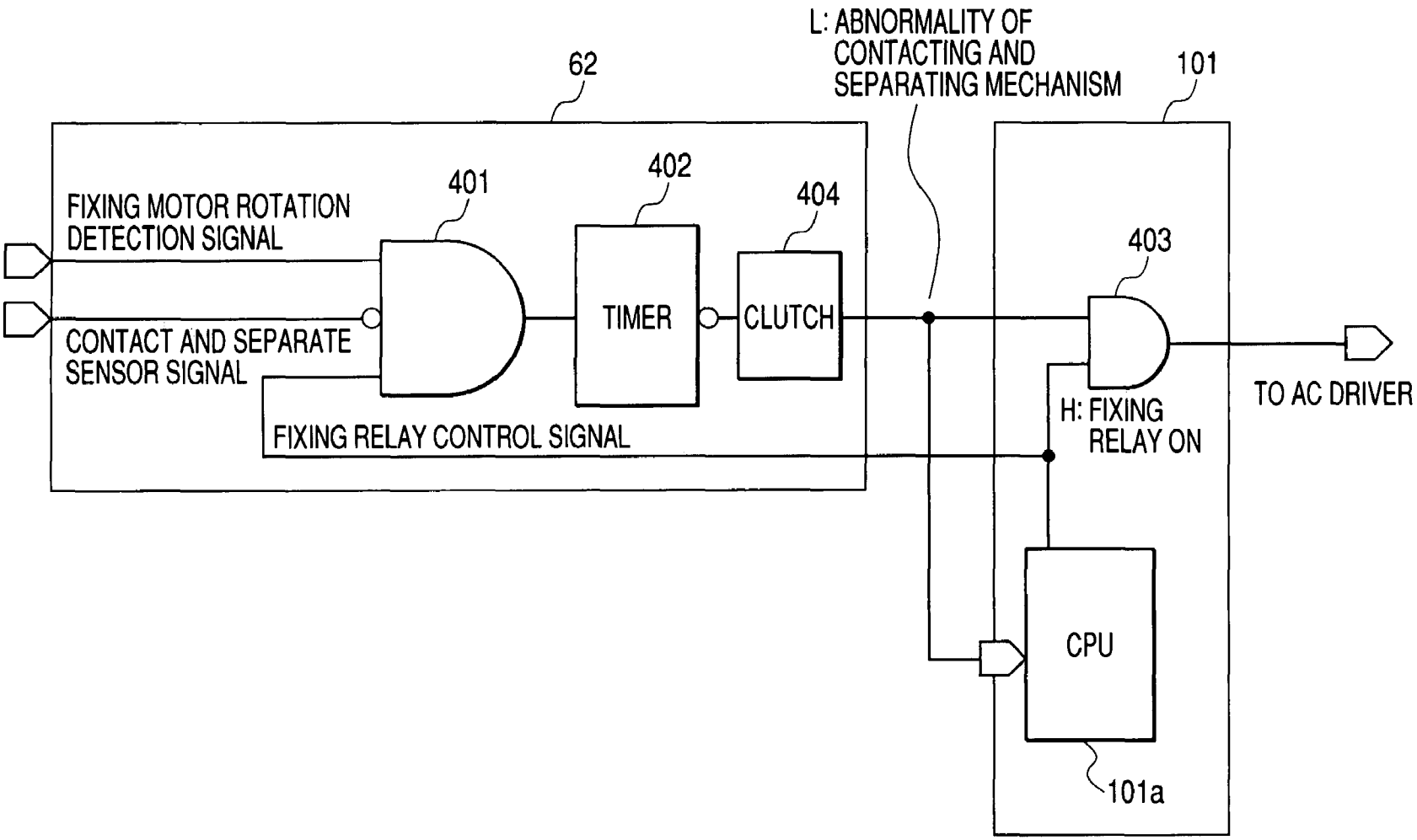
FIG. 5 is a diagram showing an embodiment of the abnormality judging means of the contacting-and-separating mechanism according to the present invention.

A numeral 62 in FIG. 5 represents a block diagram showing an internal circuit of the contacting-and-separating abnormality judging means, wherein this circuit is one example of a circuit for judging the abnormality of the contacting-and-separating mechanism from the logic of the three categories of signals described above. Namely, the contacting-and-separating abnormality judging means 62 detects, by use of a logic device as an electric device and a timer circuit 402, that the contacting-and-separating mechanism is in an abnormal state if there continues for a preset time "t" an ON-state when the fixing relay control signal is "H", a stop state when the rotation detection signal of the fixing motor is "H" and a contacting state when the contacting-and-separating sensor signal is "L". Herein, the predetermined time "t"measured by the timer 402 is set to a fixed value of 10 sec in order to prevent a malfunction and may also be set to a different predetermined time suited to convenience of the apparatus or may be contrived to be variable. Further, logic 401 is structured suitably for the logic of the color copying machine in the present embodiment, however, when the logic of the three categories of signals such as the control signal of the fixing relay 112, the rotation detection signal of the fixing motor 26 and the contacting state signal of the contacting-and-separating sensor 61 changes depending on circuitry and a mechanical configuration, and when the logic 401 is structured suitably for the logic of each signal of the apparatus, the same abnormality detection judging mechanism can be actualized.

Further, as in the present embodiment, when the fixing relay ON/OFF signal to the AC driver 110 is generated by logic 403 on the basis of the fixing relay control signal from the CPU 101*a*, the fixing relay ON/OFF signal to the AC driver 110 is fixed to an [OFF-side] if the contacting-and-separating mechanism is abnormal, the fixing relay is forcibly set OFF, whereby the apparatus can be protected. Herein, the contacting-and-separating mechanism judging means 62 is provided with a latch circuit 404, and hence, if the abnormality is once detected, the fixing relay can continue to be OFF till the abnormal state is obviated in a way that switches the color copying machine ON and OFF.

Moreover, in the present embodiment, the contacting-and-separating mechanism judging means 62 and the logic 403 are constructed of the hardware circuits, and therefore, even if the software falls into a hang-up state and performs contact-control of the external heating roller when the fixing roller 21 stops, the fixing relay 112 can be forcibly set OFF hardwarewise, thereby enhancing protection performance of the fixing roller.

(Details of Control in Image Forming Apparatus)

Next, details of the control according to the present invention will be explained with reference to FIGS. 6 through 10.

(Control at Warm-up)

FIG. 6 shows details of the control when in warm-up. To begin with, as shown in FIG. 3, upon power-ON of the main power source of the color copying machine (S1), the external heating roller 29 is moved to a home position (S2). The "home position" indicates herein a predetermined position in which the external heating roller 29 separates from the fixing roller 21. Subsequently, the fixing relay is set ON (S3), and a contacting-and-separating error detection sequence is started (S4). The contacting-and-separating error detection sequence will be explained with reference to FIG. 4.

(Contacting-and-Separating Error Detection Sequence)

Figure 10:
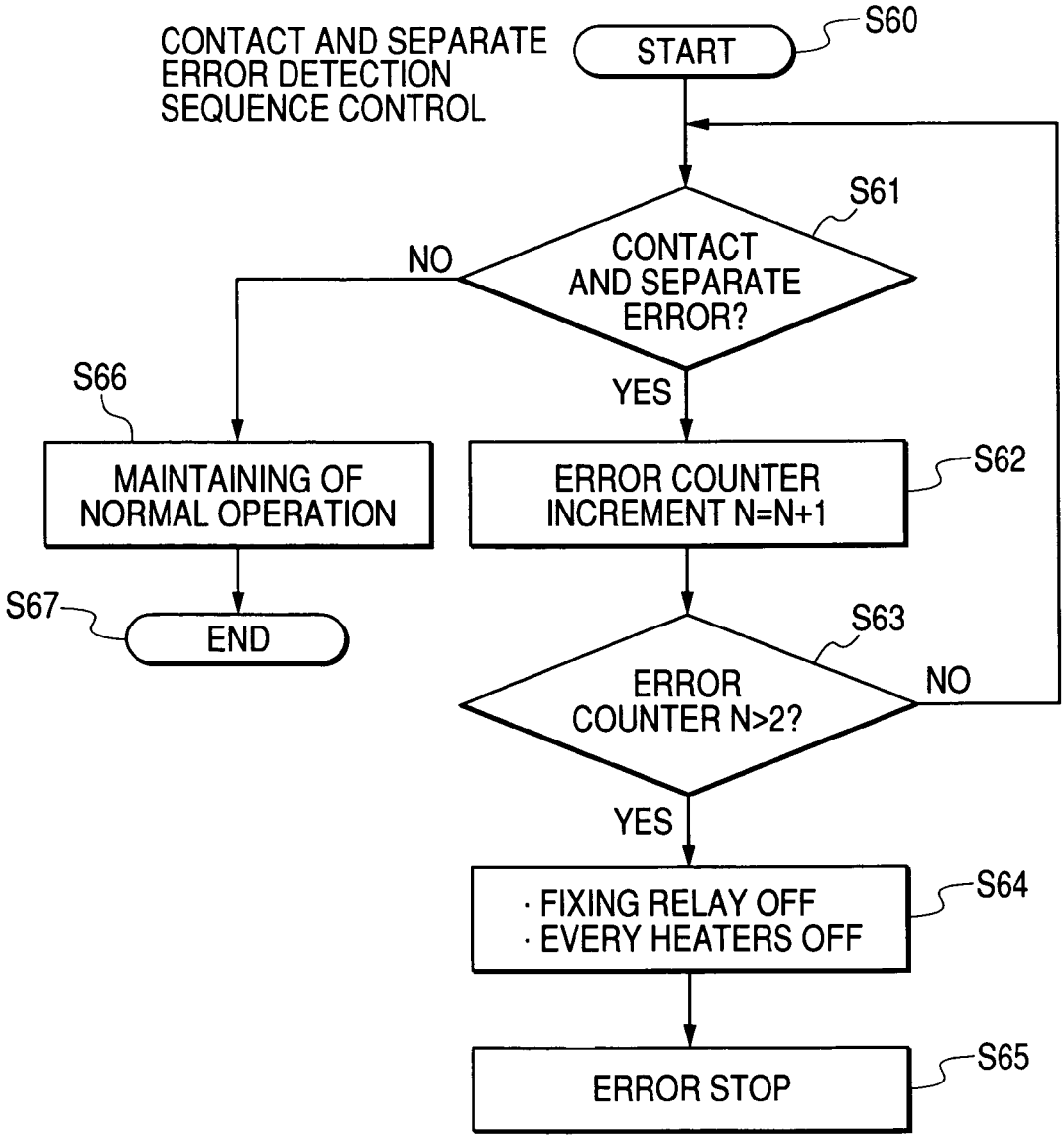
FIG. 10 is a flowchart showing a contacting-and-separating error detection sequence of the image forming apparatus according to the present invention.

Contacting-and-Separating Error Detection Sequence Flow: FIG. 10 shows an example of a power source check operation sequence flow. This sequence is that the system controller 101 monitors at a predetermined interval an error signal transmitted in a case where the ON-state indicated by the fixing relay control signal, the stop state indicated by the rotation detection signal of the fixing motor and the contacting state indicated by the contacting-and-separating sensor signal, continue for a preset period of time. The predetermined interval is a fixed periodic time measured by the CPU 101*a* within the system controller 101.

Upon a start of the contacting-and-separating detection sequence (S60), the system controller 101 judges, based on a signal from the contacting-and-separating abnormality judging means 62, whether in the contacting-and-separating abnormal state or not (S61). When not in the abnormal state, the normal operation proceeds (S66), then the contacting-and-separating error detection sequence is temporarily terminated (S67), and there is a wait for the contacting-and-separating error detection sequence to restart.

When, on the other hand, when judged to be in the abnormal state in S61, an unillustrated error counter provided in the system controller 101 is incremented by 1. When an error counter value comes to a predetermined value (which is herein equal to or larger than 3)(S63), the system controller 101 judges that the contacting-and-separating abnormality occurs. This error counter prevents misjudgment and is derived from noise of the signal received from the contacting-and-separating abnormality judging means 62 and judges it abnormal that the error state continues a plurality of times consecutively.

When recognizing in S63 a contacting-and-separating abnormal state because of an excess of the error counter value over the predetermined value, the fixing relay is forcibly set OFF, and the system controller 101 switches OFF the respective heaters 22, 24, 30 within the fixing apparatus 3 (S64) and, after executing other various categories of error processing, stops the color copying machine due to the error (S65). Thereafter, the system controller 101 instructs a display portion to display the error, thus getting the user to recognize the error.

It is to be noted that when the CPU 101*a* within the system controller 101 controls the external heating roller 29 to contact or separate from the fixing roller 21, an error is, apart from the present sequence, detected softwarewise by checking coincidence or non-coincidence between the signal showing the contacting or separating control state and the signal showing the contacting or separating state, which is transmitted from the contacting-and-separating sensor.

The discussion will get back to the control when in the warm-up in FIG. 6. It is checked whether or not the surface temperatures of the external heating roller 29, the fixing roller 21 and the pressure roller 23 reach the control temperatures of 230° C., 200° C. and 170° C., respectively (S5). Herein, when the respective surface temperatures reach the control temperatures, after setting the fixing motor 26 OFF and separating the external heating roller 29 from the fixing roller 21, the operation moves to a standby status (however, immediately after switching the power source ON, pre-control is that the fixing motor 26 is set in the OFF-state, and the external heating roller 29 is set in the state of being separated from the fixing roller 21).

While on the other hand, when the respective surface temperatures do not yet reach the control temperatures (S5), it is next checked whether or not the surface temperature of the fixing roller 21 reaches the control temperature of 200° C. (S6).

Herein, when not reaching the control temperature, the halogen heater 22 is switched ON (S7). When reached, the halogen heater 22 is switched OFF (S8).

Subsequently, it is checked whether or not the surface temperature of the pressure roller 23 reaches the control temperature of 170° C. (S9).

Herein, when not reaching the control temperature, the halogen heater 24 is switched ON (S10). When reached, the halogen heater 24 is switched OFF (S11).

Further subsequently, it is checked whether or not the surface temperature of the external heating roller 29 reaches the control temperature of 230° C. (S12). When not reached, the external heating heater 30 is switched ON (S13). When reached, the external heating heater 30 is switched OFF (S14).

Subsequent to the sequence described above, it is checked whether or not each of the surface temperatures of the fixing roller 21 and the external heating roller 29 reaches a temperature proper to get the external heating roller 29 in contact therewith (S15). Here, when the surface temperatures of the respective rollers reach predetermined temperatures (which are herein 120° C. for the fixing roller 21 and 200° C. for the external heating roller 29), to begin with, the fixing roller starts rotating, and next the external heating roller 29 is brought into contact with the fixing roller 21 (S16). Note that the fixing roller 21 remains stopped, and the external heating roller 29 remains separated from the fixing roller 21 in the initial state of the present warm-up sequence.

The operations described above are conducted till the surface temperatures of the external heating roller 29, the fixing roller 21 and the pressure roller 23 reach the control temperatures of 230° C., 200° C. and 170° C., respectively. When these surface temperatures reach the control temperatures respectively, the operation moves to a standby sequence that will be described below.

(Standby Sequence)

Figure 7:
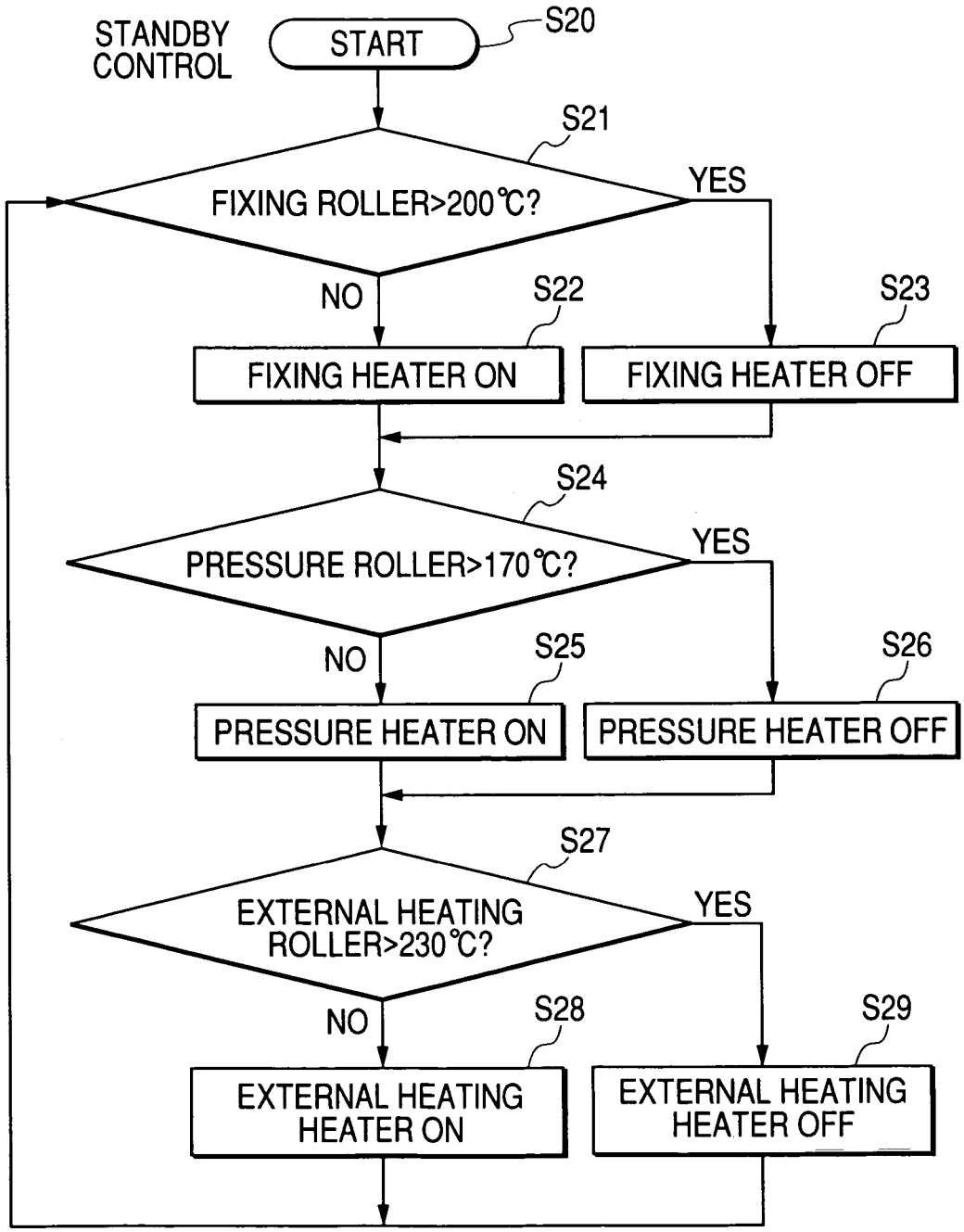
FIG. 7 is a flowchart showing a standby sequence of the image forming apparatus according to the present invention.

The standby sequence will be explained with reference to FIG. 7.

Upon moving to a standby status (S20), at first, it is checked whether or not the surface temperature of the fixing roller 21 reaches a control temperature of 200° C. (S21). Herein, when not reaching the control temperature, the halogen heater 22 is switched ON (S22). When reached, the halogen heater 22 is switched OFF (S23).

Subsequently, it is checked whether or not the surface temperature of the pressure roller 23 reaches a control temperature of 170° C. (S24).

Herein, when not reaching the control temperature, the halogen heater 24 is switched ON (S25). When reached, the halogen heater 24 is switched OFF (S26).

Further subsequently, it is checked whether or not the surface temperature of the external heating roller 29 reaches a control temperature of 230° C. (S27). When not reached, the external heating heater 30 is switched ON (S28). When reached, the external heating heater 30 is switched OFF (S28).

The operations explained above are performed during the standby-status till the color copying machine effects the image forming operation, and upon a start of the image forming operation, the operation moves to a copy sequence that will be described below.

(Copy Sequence)

Figure 8:
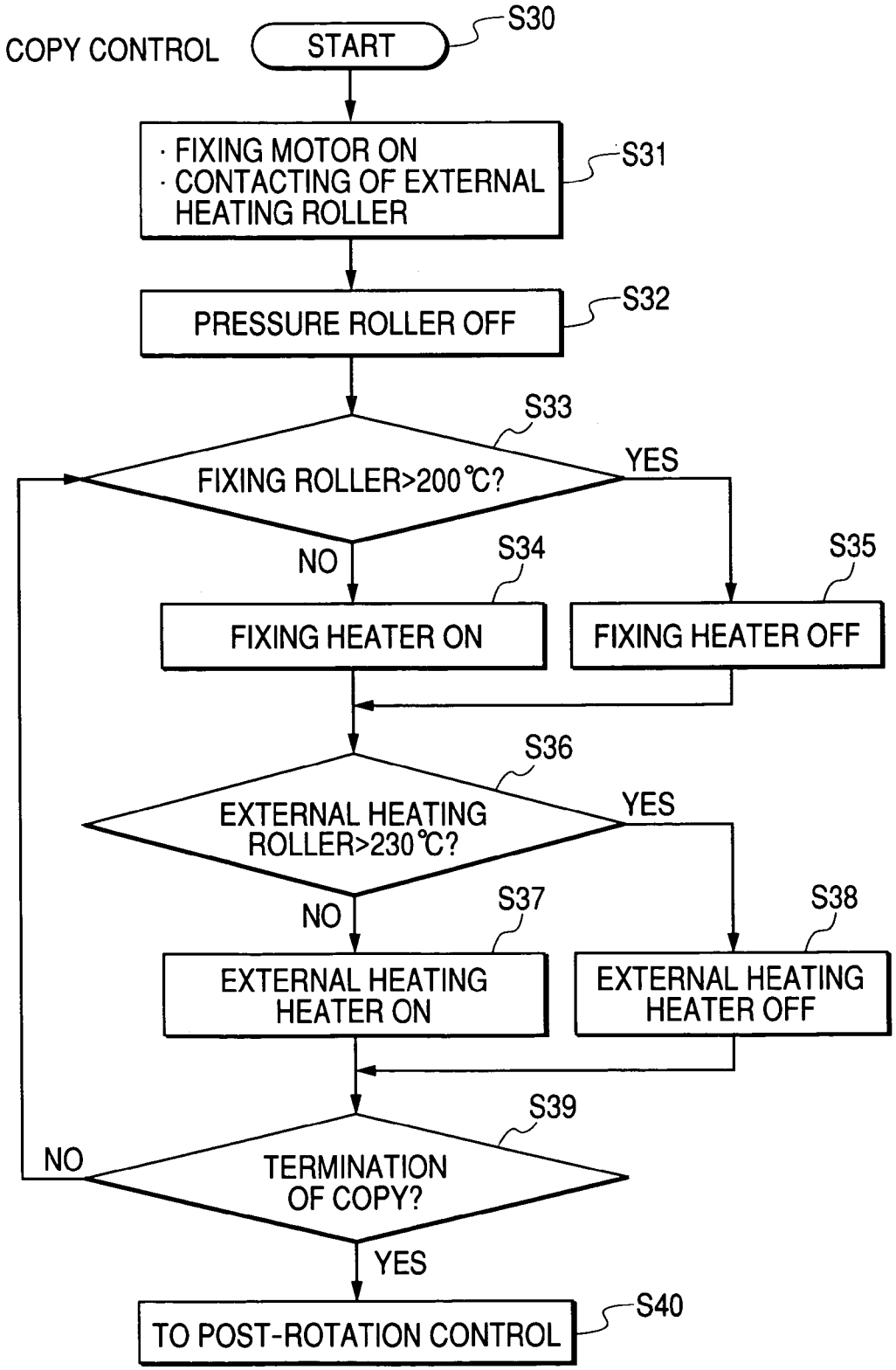
FIG. 8 is a flowchart showing a copy sequence of the image forming apparatus according to the present invention.

The copy sequence will subsequently be explained in conjunction with FIG. 8.

Upon a start of the copy sequence (S30), at first the fixing roller 21 starts rotating, and next the external heating roller 29 comes into contact with the fixing roller 21 (S31). Further, the halogen heater 24 is switched OFF for the duration of the copy sequence in order to save the electric power (S32). The present fixing apparatus 3 is, however, designed to obtain sufficient fixing performance even when the halogen heater is kept OFF.

Subsequently, it is checked whether or not the surface temperature of the fixing roller 21 reaches the control temperature of 200° C. (S33). Herein, when not reaching the control temperature, the halogen heater 22 is switched ON (S34). When reached, the halogen heater 22 is switched OFF (S35).

Further subsequently, it is checked whether or not the surface temperature of the external heating roller 29 reaches the control temperature of 230° C. (S36). When not reached, the external heating heater 30 is switched ON (S37). When reached, the external heating heater 30 is switched OFF (S38).

The aforementioned sequence is conducted till the copying operation (which is equal to the image forming operation) is terminated. When the copying operation is not yet terminated, the operation returns to S33. When terminated, the operation moves to a next post-rotation sequence (S40).

Figure 9:
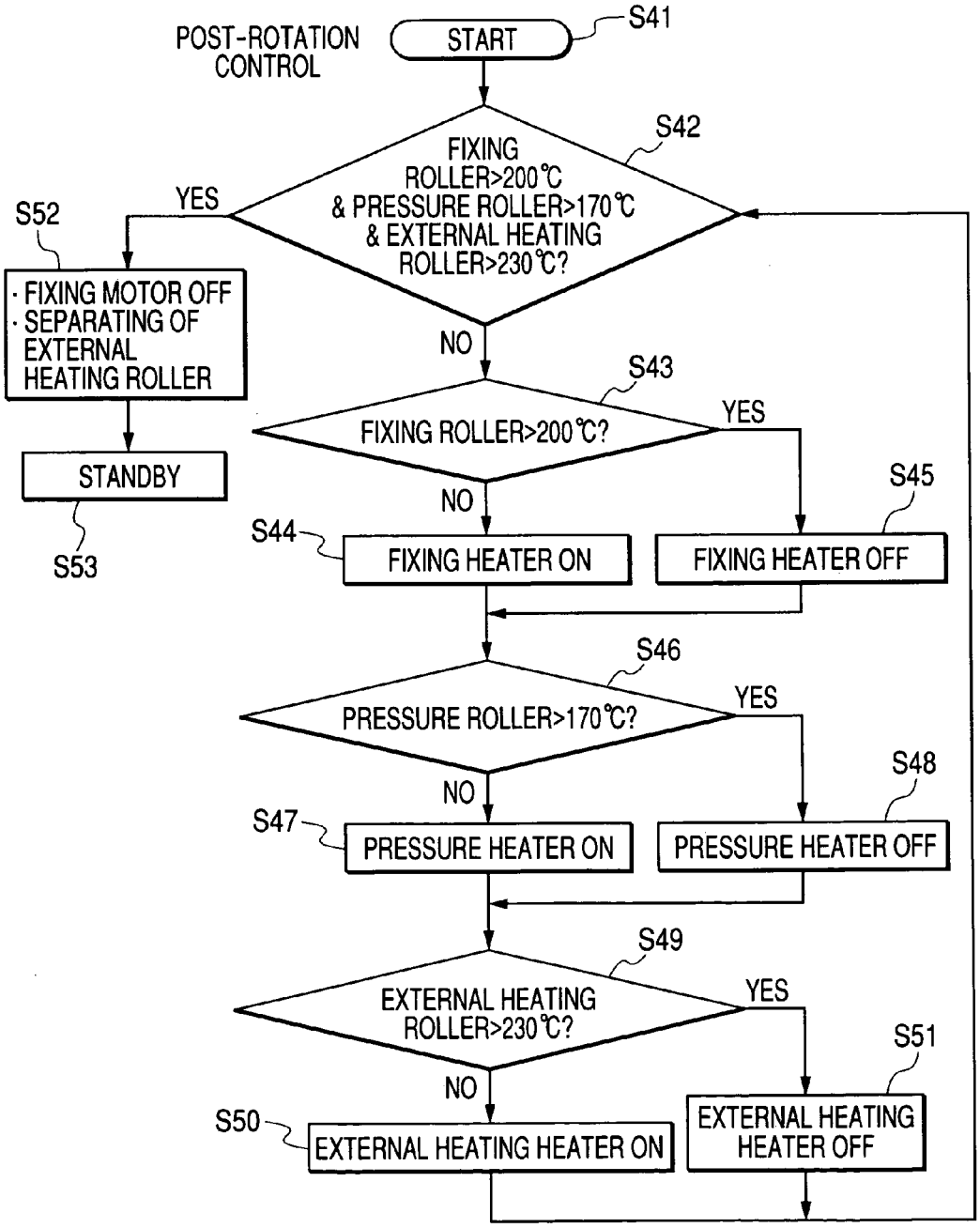
FIG. 9 is a flowchart showing a post-rotation sequence of the image forming apparatus according to the present invention.

The post-rotation sequence will next be explained with reference to FIG. 9. Upon a start of the post-rotation sequence (S41), to begin with, it is checked whether or not the surface temperatures of the external heating roller 29, the fixing roller 21 and the pressure roller 23 reach the control temperatures of 230° C., 200° C. and 170° C., respectively (S42).

Herein, when the respective surface temperatures reach the control temperatures, after separating the external heating roller 29 from the fixing roller 21 and stopping the rotation of the fixing roller 21 (S52), the operation moves to a standby status (S53).

While on the other hand, when the respective surface temperatures do not yet reach the control temperatures, it is next checked whether or not the surface temperature of the fixing roller 21 reaches the control temperature of 200° C. (S43).

Herein, when not reaching the control temperature, the halogen heater 22 is switched ON (S44). When reached, the halogen heater 22 is switched OFF (S45).

Subsequently, it is checked whether or not the surface temperature of the pressure roller 23 reaches the control temperature of 170° C. (S46).

Herein, when not reaching the control temperature, the halogen heater 24 is switched ON (S47). When reached, the halogen heater 24 is switched OFF (S48).

Further subsequently, it is checked whether or not the surface temperature of the external heating roller 29 reaches the control temperature of 230° C. (S49). When not reached, the external heating heater 30 is switched ON (S50). When reached, the external heating heater 30 is switched OFF (S51).

The operations described above are conducted till the surface temperatures of the external heating roller 29, the fixing roller 21 and the pressure roller 23 reach the control temperatures of 230° C., 200° C. and 170° C., respectively. When these surface temperatures reach the control temperatures respectively, the operation moves back again to the standby sequence.

According to the embodiment of the present invention explained above, the control signal of the fixing relay 112 is inputted as the heater control signal inputted to the contacting-and-separating abnormality judging means 62. As this control signal, however, one or a plurality of ON-control signals of the heaters 22, 24, 30 within the fixing apparatus 3 may also be inputted.

Moreover, according to the embodiment of the present invention, the circuit is constructed to switch the fixing relay 112 OFF when the contacting-and-separating abnormality judging means 62 detects the abnormality, however, the processing executed when detecting the abnormality is not limited this processing. The heaters 22, 24, 30 of the fixing apparatus 3 are provided with switches for making the electric connections and disconnections between the AC driver 110 and the heaters 22, 24, 30 through the fixing relay 112, wherein the respective switches are controlled ON and OFF by control signals outputted from the AC driver 110. Accordingly, as the processing executed when detecting the abnormality, the circuit may also be constructed not so that the ON-control signal with respect to the fixing relay 112 is set OFF but so that one or a plurality of ON-control signals of the heaters 22, 24, 30 outputted from the AC driver 110 are set OFF. These switches of the heaters 22, 24, 30 can be constructed of semiconductor switch means such as TRIAC but are not limited to the semiconductor switch. Herein, the switch for the halogen heater corresponds to a first switch means, the switch for the external heating heater corresponds to a second switch means, and the AC driver 110 corresponds to first and second switch control means, respectively.

Further, the circuit may also be constructed so that when the contacting-and-separating abnormality judging means 62 detects the abnormality of the contacting-and-separating mechanism, the fixing relay 112 is set OFF, and one or a plurality of ON-control signals of the respective heaters 22, 24, 30 within the fixing apparatus 3 are set OFF. For example, this is a case wherein if the contact detecting means detects due to a trouble of the software that the external heating member is separated at the must-contact time when effectuating the fixing operation and when the temperature of each halogen heater is performed during the rotations of the fixing roller, a judgment of being abnormal is made.

Note that the case of structuring the pressure roller 23 by use of the halogen heater 24 as the heat source provided inside has been discussed so far, however, the pressure roller 23 can also be structure without including the halogen heater 24.

Further, the embodiment described above adopts the construction for judging the abnormality of the contacting-and-separating state after the rotation of the image heating member. Other than this construction, however, there can also be taken a construction for making a judgment of being abnormal when detecting due to a trouble of the software, etc. on standby that the external heating member contacts at the must-separate time.

Moreover, the couple of fixing members are constructed of the 2-rollers system consisting of the fixing roller 40 and the pressure roller 41 and may also involve the use of a belt system other than the rollers.

Still further, there has been made the discussion on the case of configuring the external heating member by use of the external heating roller 29, however, it is possible to configure the external heating member by use of a belt composed of a resin, a rubber, a metal, etc., and a non-contact type heat source, excluding the roller.

Moreover, the detecting members of the surface temperatures of the fixing roller 21, the pressure roller 23 and the external heating roller 29, are constructed as the contact type and can also be constructed as a non-contact type.

The present invention can be applied to even a system in which the pressure member is provided with the external heating member.

Figure 11:
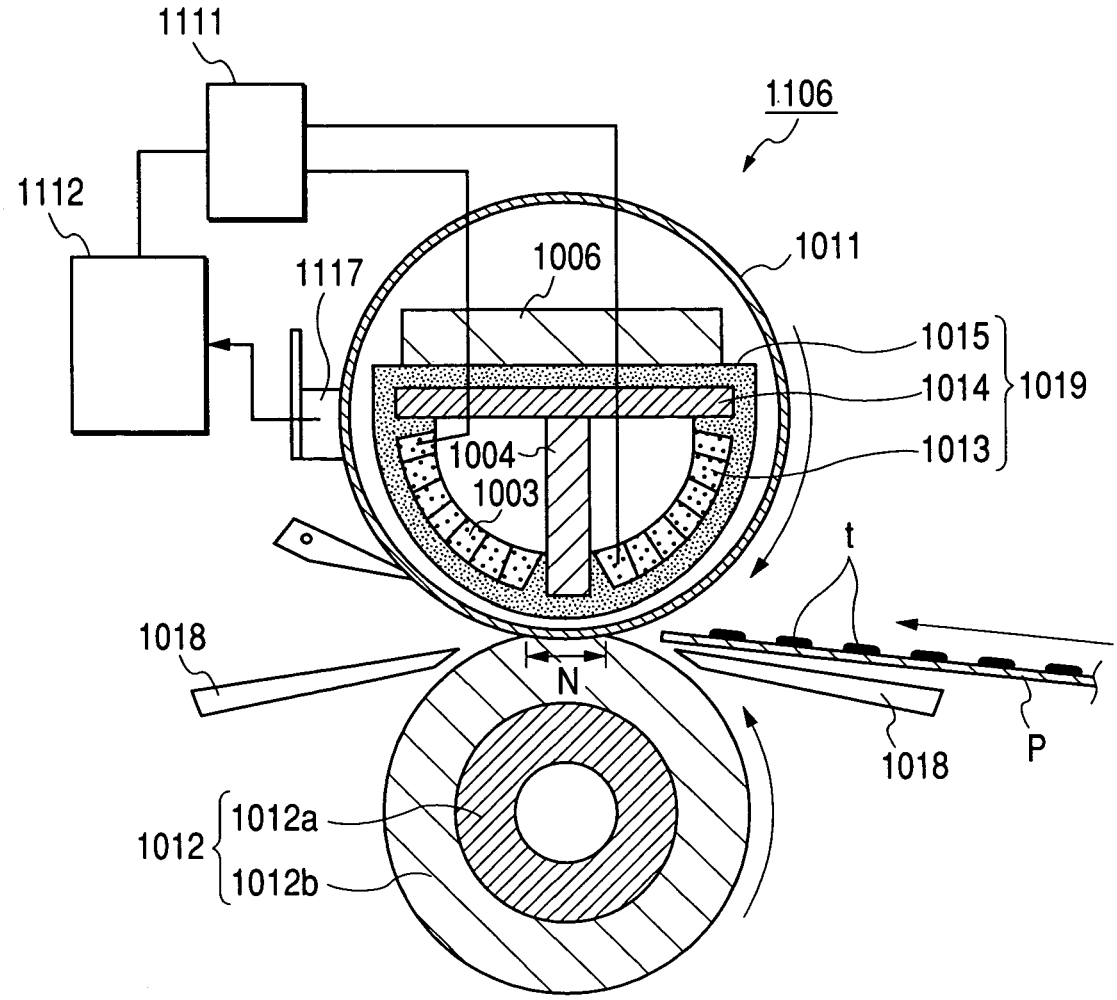
FIG. 11 is a view showing a configuration of an image heating apparatus involving the use of an induction heating system according to the present invention.

The present embodiment adopts the construction in which the fixing roller is heated by the halogen heater, however, the present invention is not confined to this construction. None of problems might occur even when the present invention is applied to an induction heating system-based configuration as other example, wherein the heating member itself emits the heat by dint of an eddy current generated in a conductive layer of the heating member due to a magnetic field by use of a coil that generates the magnetic field. FIG. 11 is a cross-sectional model view of a heating/fixing apparatus 1106 involving the use of the heating apparatus of the present invention as a heat source. The heating/fixing apparatus 1106 in this example is a heat roller type apparatus, wherein a recording sheet P as a recording material bearing an unfixed toner image "t" is led to, then nipped and conveyed by a fixing nip portion N as a pressure-contact portion between the fixing roller 1011 as a heating member subjected to the induction heating and a pressure roller 1012 as a pressure member, and the fixing nip portion N fixes the unfixed toner image "t" by thermally pressing it onto the surface by its nip pressure and the heat of the fixing roller 1011.

The fixing roller 1011, which is 40 mm in major diameter and 0.7 mm in thickness, is a core metal cylinder composed of iron that is defined as a magnetic metal member. A layer having thickness of 10 to 50 μm and composed of fluororesin such as PTFE, PFA, etc may be coated over an outer peripheral surface of the fixing roller 1011 in order to enhance a releasing property of its surface.

The fixing roller 1011 is supported on and secured, at its side end portions, to a fixing unit frame rotatably through bearings. The fixing roller 1011 is rotationally driven clockwise as indicated by an arrowhead at a predetermined peripheral speed by an unillustrated drive system.

The pressure roller 1012 is constructed of a hollowed core metal 1012*a* and an elastic layer 1012*b* as a surface releasing property heat resistance rubber layer formed on an outer peripheral surface thereof. The pressure roller 1012 is disposed under the fixing roller 1011 in a side-by-side relationship with this fixing roller 1011, and side end portions of the hollowed core metal 1012*a* are supported on the unillustrated unit frame rotatably through the bearings. The pressure roller 1012 is biased up towards a rotation axis of the fixing roller 1011 by an unillustrated biasing mechanism using a spring or the like, and is thus pushed (pressurized) by a predetermined pressing force against a lower surface of the fixing roller 1011.

The elastic layer 1012*b* elastically deforms at a press-contact portion with the fixing roller 1011 by dint of the press-contact of the pressure roller 1012 with the fixing roller 1011, thereby forming a fixing nip portion N, as a heated material heating portion, having a predetermined width between the fixing roller 1011 and the pressure roller 1012. In this example, the pressure roller 1012 receives a load having a total pressure of approximately 304 N (about 30-Kg weight), and in this case the nip width of the fixing nip portion N becomes approximately 6 mm. With the rotational drive of the fixing roller 1011, the pressure roller 1012 is rotationally driven by a frictional force at the fixing nip portion N. The total pressure and the nip width are, however, given as nothing but one example, and there is no problem at all if other values are taken.

The numeral 19 designates an induction coil assembly as a magnetic flux generating means, and is constructed of an induction coil 1013, a magnetic core 1014, a coil holder 1015, and so on. The induction coil 1013 is covered with a covering member composed of a heat resistance material such as polyimide, polyamideimide, etc. The coil holder 1015 is a member taking a semicircular bucket-like shape in cross section, which is formed of a heat resistance resin such as PPS, PEEK, phenol resin, etc. The coil holder 1015 houses the induction coil 1013 wound in a ship-like shape and the magnetic core 1014 combined with in a T-like shape with tabular ferrite having thickness of 4 mm, thereby structuring an induction coil assembly 1019. An outer surface of the coil holder 1015 is disposed in a face-to-face relationship with an inner surface of the fixing roller 1011. Further, the induction coil 1013 is tightly fitted to the coil holder 1015.

The induction coil assembly 1019 is held by a stay 1006 and thus inserted into the hollowed portion of the fixing roller 1011. The induction coil assembly 1019 is supported by fixing both of end portions of the stay 1006 to the unillustrated fixing unit frame with such a posture that a semicircular surface side of the coil holder 1015 is directed downwards. The induction coil assembly 1019 is so disposed as to form a gap between the induction coil assembly 1019 and the fixing roller 1011.

The pressure roller 1012 is rotationally driven with the rotational drive of the fixing roller 1011, and an exciting circuit 1111 applies an alternate current of 10 to 100 kHz to the induction coil 1013. A magnetic field induced by the alternate current causes an eddy current to flow across the inner surface of the fixing roller 1011 as the conductive layer, thereby generating Joule heat. Namely, the fixing roller 1011 is induction-heated. According to the present invention, even when this type of induction heating apparatus is provided with the external heating member described above, the same effects can be acquired.

Moreover, the same effects as those of the present invention can be acquired from a construction involving the use of the aforementioned induction heating system by providing the external heating member with the coil that generates the magnetic field as the current flows and with an exothermic layer composed of iron, etc. that emits the heat when receiving the eddy current produced by the magnetic field.

The present invention, which has the constructions and operations described above, was devised to obviate the problems inherent in the prior arts given above. According to the present invention, it is possible to reduce, in a way that heats the image heating member in a comparatively short time by controlling the temperature of the external heating member on standby, deterioration of and a damage to the fixing member which are caused by the abutment of the external heating member upon the fixing member when there occurs such abnormality that the external heating member does not separate from the image heating member if the rotation driving means abnormally stops, if the contacting-and-separating means for making the external heating roller contact and separate becomes defective in its operation and if the software for controlling the rotation driving means and the contacting-and-separating means falls into the a hang-up state.

The present invention has been discussed so far by way of the embodiment and can be modified in whatever forms within the technical concept of the present invention without being limited to the embodiment discussed above.

What is claimed is:

1. An image heating apparatus comprising:

an image heating rotation member that is configured and positioned to rotate and to heat an image on a recording material;

driving means for rotationally driving said image heating rotation member;

an external heating member including an exothermic member, said external heating member being configured and positioned to contact and separate from said image heating rotation member, wherein said external heating member heats said image heating rotation member by contact therewith;

contacting-and-separating means for making said external heating member contact and separate from said image heating rotation member;

conduction control means for controlling conduction to said exothermic member so that the temperature of said external heating member becomes a target temperature;

contacting-and-separating state detecting means for detecting for detecting a contacting-and-separating state of said external heating member with respect to said image heating rotation member; and abnormality detecting means for detecting an abnormality in the contacting-and-separating state of said external heating member controlled by said contacting-and-separating means, on the basis of the detection by said contacting-and-separating state detecting means.

2. An image heating apparatus according to claim 1, further comprising rotation detecting means for detecting rotation of said image heating rotation member and a switch device configured and positioned to electrically connect said exothermic member to a power source in an electrical closing state and to electrically disconnect said exothermic member from the power source in an electrical opening state, wherein said abnormality detecting means detects an abnormality of the contacting-and-separating state of said external heating member with respect to the electrical opening and closing states of said switch device from the detection by said rotation detecting means when detecting the contacting state in which said external heating member contacts said image heating rotation member.

3. An image heating apparatus according to claim 2, wherein said abnormality detecting means is an electric circuit including an electric device to which an output of said contacting-and-separating means, an output of said rotation detecting means and the electrical opening and closing states of said switch device are inputted.

4. An image heating apparatus according to claim 2, wherein said abnormality detecting means includes a logic device configured to perform a logic operation by use of an output of said contacting-and-separating means, an output of said rotation detection means and the electrical opening and closing states of said switch device.

5. An image heating apparatus according to claim 2, wherein said abnormality detecting means detects the abnormality in the case that said external heating member contacts said image heating rotation member during the electrical closing state of said switch device when said image heating rotation member stops rotating.

6. An image heating apparatus according to claim 1, further comprising a switch device configured to electrically connect said exothermic member to a power source in an electrical closing state and to electrically disconnect said exothermic member from the power source in an electrical opening state, wherein a signal for setting the electrical opening state of said switch device is outputted from said abnormality detecting means when said abnormality detecting means detects the abnormality.

7. An image heating apparatus according to claim 1, further comprising a switch device configured to electrically connect said exothermic member to a power source in an electrical closing state and to electrically disconnect said exothermic member from the power source in an electrical opening state, wherein when an abnormality signal is outputted from said abnormality detecting means even after a preset time, said switch device comes to the electrical closing state.

8. An image heating apparatus according to claim 7, wherein when said switch device assumes the electrical opening state when said abnormality detecting means detects the abnormality, the abnormality is displayed on an operation portion.

9. An image heating apparatus according to claim 1, wherein when said contact-and-separating state detecting means outputs a detection of the separation of said external heating member from said image heating rotation member, the temperature of said external heating member is controlled.

10. An image heating apparatus according to claim 1, wherein when an abnormal state is obviated after said abnormality detecting means has detected the an abnormality, the abnormal state is canceled.

11. An image heating apparatus according to claim 1, wherein said image heating rotation member includes an exothermic member and second conduction control means for controlling conduction to said exothermic member of said image heating rotation member, and said second conduction control means makes the conduction to said exothermic member so that the temperature of said image heating rotation member becomes a target temperature lower than the target temperature of said external heating member.

12. An image heating apparatus according to claim 1, further comprising rotation detecting means for detecting a rotation of said image heating rotation member and a switch device configured to electrically connect said exothermic member to a power source in an electrical closing state and to electrically disconnect said exothermic member from the power source in an electrical opening state.

wherein said abnormality detecting means detects an abnormality of the contacting-and-separating state of said external heating member from the detection by said rotation detecting means and from a result of the detection by said contacting-and-separating state detecting means with respect to the electrical opening and closing states of said switch device.

13. An image heating apparatus according to claim 1, wherein said image heating rotation member includes an elastic layer.

14. An image heating apparatus according to claim 1, further comprising a coil generating a magnetic field when an electric current flows therein, wherein said image heating rotation member includes a conductive layer emitting heat as a result of an eddy current produced by the magnetic field.

* * * * *

UNITED STATES PATENT AND TRADEMARK OFFICE

CERTIFICATE OF CORRECTION

PATENT NO. : 7,058,329 B2
APPLICATION NO. : 10/845208
DATED : June 6, 2006
INVENTOR(S) : Katsumi Takahashi It is certified that error appears in the above-identified patent and that said Letters Patent is hereby corrected as shown below:

COLUMN 1:
Line 29, “etc.” should read --etc.,--.

COLUMN 4:
Line 27, “CCD” should read --CCD,--.

COLUMN 5:
Line 62, “etc.” should read --etc.,--.

COLUMN 7:
Line 11, “switch” should read --switch,--.

COLUMN 8:
Line 56, “respect the” should read --respect to the--.

COLUMN 9:
Line 4, “etc.” should read --etc.,--.
Line 11, “etc.” should read --etc.,--.
Line 12, “ext.” should read --etc.,--.

COLUMN 10:
Line 15, “till” should read --until--.

COLUMN 12:
Line 3, “till” should read --until--.
Line 32, “till” should read --until--.

COLUMN 13:
Line 29, “till” should read --until--.
Line 49, “limited this” should read --limited to this--.

COLUMN 14:
Line 17, “structure” should read --structured--.
Line 25, “etc.” should read --etc.,--.
Line 40, “dint” should read --virtue--.

COLUMN 15:
Line 3, “etc” should read --etc.,--.
Line 25, “dint” should read --virtue--.

UNITED STATES PATENT AND TRADEMARK OFFICE

CERTIFICATE OF CORRECTION

PATENT NO. : 7,058,329 B2
APPLICATION NO. : 10/845208
DATED : June 6, 2006
INVENTOR(S) : Katsumi Takahashi It is certified that error appears in the above-identified patent and that said Letters Patent is hereby corrected as shown below:

COLUMN 16:
Line 14, "etc." should read --etc.,--.
Line 57, "for detecting" should be deleted.

COLUMN 18:
Line 12, "the" should be deleted.
Line 31, "state." should read --state,--.

Signed and Sealed this

Thirteenth Day of March, 2007

JON W. DUDAS
*Director of the United States Patent and Trademark Office*